United States Patent [19]

Taylor

[11] 4,444,426

[45] Apr. 24, 1984

[54] LOCKING DEVICE ASSEMBLY OF A LIFTING BEAM OR SPREADER PARTICULARLY FOR CONTAINERS

[76] Inventor: Richard J. Taylor, Oxelbärsgränd 13, S-162 40 Vällingby, Sweden

[21] Appl. No.: 325,426

[22] PCT Filed: Mar. 26, 1981

[86] PCT No.: PCT/SE81/00096

§ 371 Date: Nov. 20, 1981

§ 102(e) Date: Nov. 20, 1981

[87] PCT Pub. No.: WO81/02727

PCT Pub. Date: Oct. 1, 1981

[30] Foreign Application Priority Data

Mar. 26, 1980 [SE] Sweden ..... 8002353

[51] Int. Cl.[3] ..... B66C 1/42

[52] U.S. Cl. ..... 294/81 SF; 294/67 DA; 294/67 R

[58] Field of Search ..... 294/81 SF, 67 A, 67 B, 294/67 BB, 67 D, 67 DA, 67 DB, 81 R, 67 R; 414/607, 608, 620, 621, 730; 105/463, 464, 465

[56] References Cited

U.S. PATENT DOCUMENTS

| | | | |
|---|---|---|---|
| 3,749,438 | 7/1973 | Loomis et al. | 294/81 SF |
| 3,751,096 | 8/1973 | Wyon | 294/67 R |
| 3,892,436 | 7/1974 | Fathauer | 294/81 SF |

FOREIGN PATENT DOCUMENTS

| | | | |
|---|---|---|---|
| 2110984 | 10/1971 | Fed. Rep. of Germany | 294/81 SF |
| 2227430 | 6/1972 | Fed. Rep. of Germany | 294/81 SF |
| 2209804 | 9/1973 | Fed. Rep. of Germany | 294/81 SF |
| 2822710 | 11/1979 | Fed. Rep. of Germany | 294/81 SF |
| 1585077 | 1/1970 | France | 294/81 SF |
| 2221378 | 3/1974 | France | 294/81 SF |
| 339740 | 9/1971 | Sweden | 294/81 SF |
| 1385528 | 2/1975 | United Kingdom | 294/81 SF |

*Primary Examiner*—James B. Marbert

*Attorney, Agent, or Firm*—Fleit, Jacobson, Cohn & Price

[57] ABSTRACT

A locking device assembly or twistlock assembly for mounting into a lifting beam or spreader, for releaseable coupling to a container having at its top side corner castings incorporating oval openings. The spreader (2) has rotatable twistlocks (20) with oval locking heads (6) which in their open position (A) can be inserted into said openings and after being rotated approximately 90 degrees to a locking position (B) secure the corner castings to the twistlock heads (6) thereby coupling together the container and the spreader. Each twistlock (20) is mounted in a bearing house and is rotated by an operating device (5) which is releasably connected to a turning element (17) surrounding the end part (14) of the twistlock (20) and demountably but unturnably affixed to the twistlock (20), e.g. by a key (18). Each twistlock (20) below the end part (14) has an annular groove (13) for insertion of removable bearing elements (15, 16), e.g. a split bearing ring, forming a stop to the bearing house (3) of the twistlock for fixation of the shaft (20) to axial displacement at lifting. The turning element (17) is arranged to keep the bearing rings (15, 16) in their position in the groove (13) and also arranged to be fixed to axial displacement by interacting means (22–25) acting between the turning element (17) and its fixed surrounding parts, in the first place the bearing house (3), in such a way that the element is fixed axially at rotation within the working area (A–B), i.e. from the open position (A) to the locking position (B) and vice versa, but is released axially for freeing and removing the bearing rings (15, 16) at rotation outside the working area.

8 Claims, 7 Drawing Figures

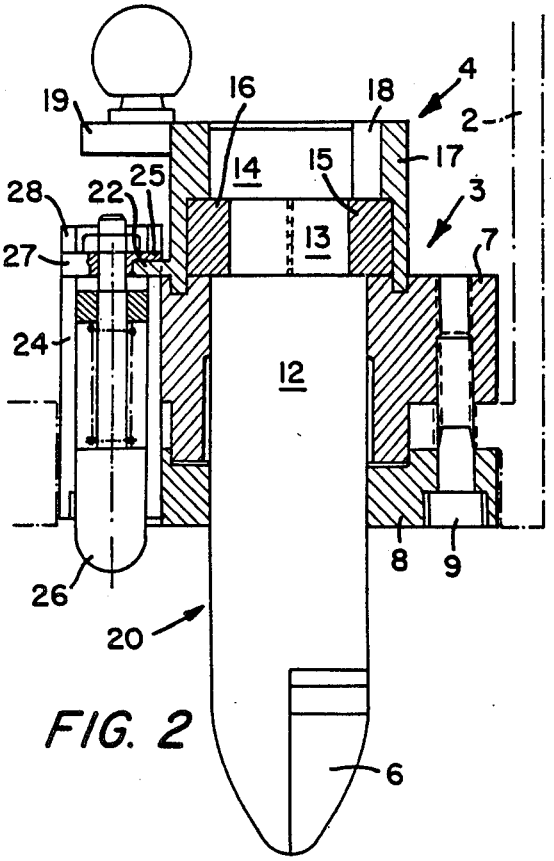
FIG. 2
FIG. 1
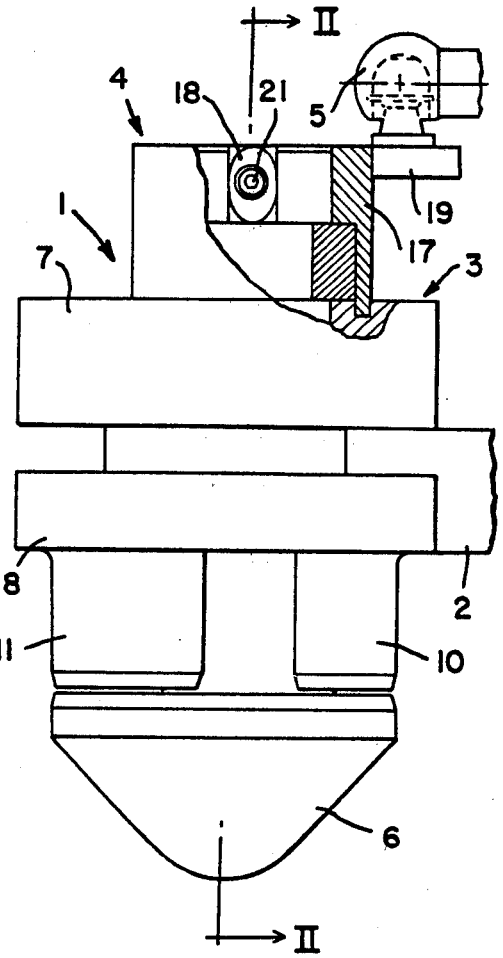
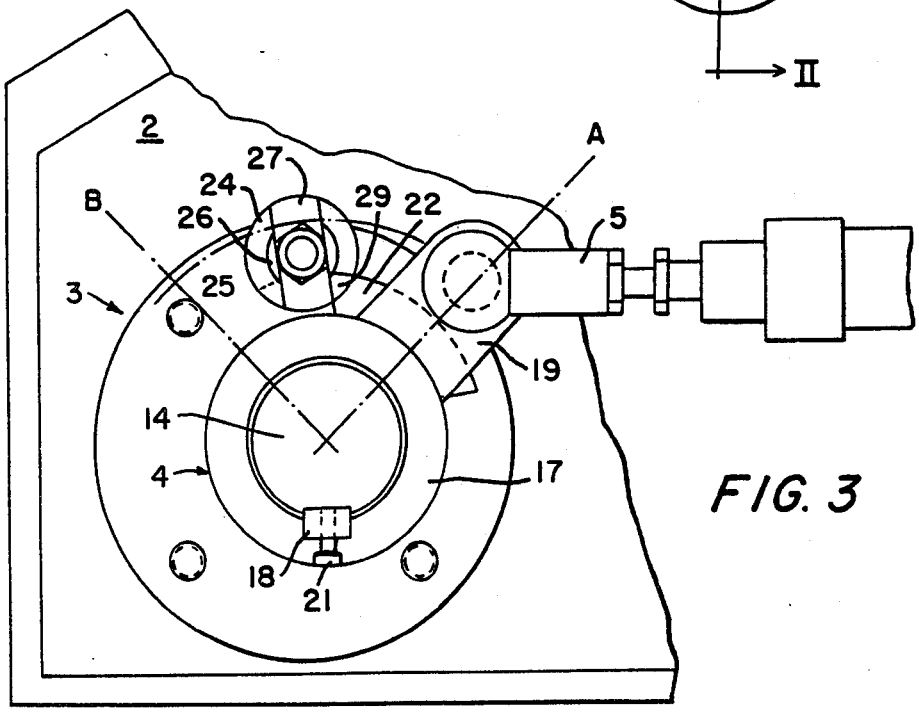
FIG. 3

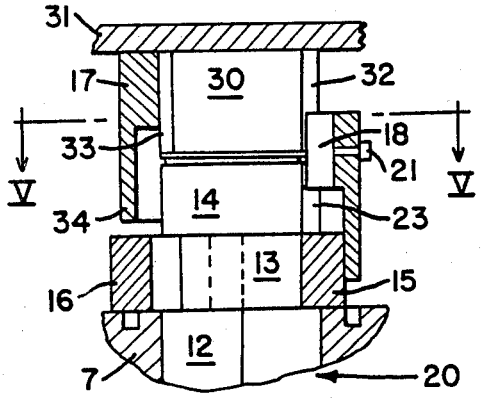
FIG. 4
FIG. 5
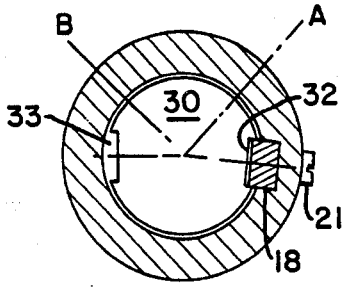
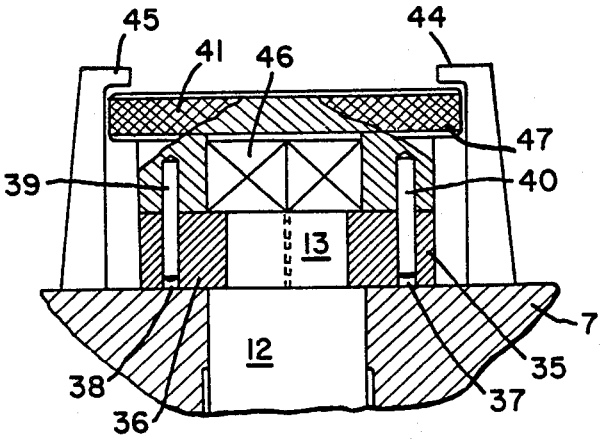
FIG. 6
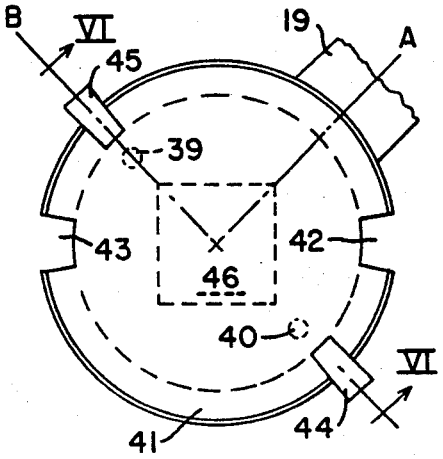
FIG. 7

LOCKING DEVICE ASSEMBLY OF A LIFTING BEAM OR SPREADER PARTICULARLY FOR CONTAINERS

The present invention relates to a locking device assembly commonly known and hereinafter referred to as a twistlock assembly for mounting into a lifting beam generally called a spreader, which is particularly designed to be coupled to load carriers, containers or the like equipped with standardised fittings to facilitate lifting, i.e. fittings incorporating openings to permit releasable coupling to a locking device such as may be fitted to a spreader. It is most important that the lifting and handling of containers is effected quickly and with great operational safety. This demands that the equipment is robustly manufactured and that, despite this, when the lifting device is damaged or deformed, repairs can be effected with the minimum of delay. All known types of spreaders require tools to effect the replacement of the twistlocks which enter into and couple with the lifting fittings of the container. These lifting fittings, which are part of the construction of a container, are hereinafter referred to as corner castings. Twistlocks, because of their extended situation, are most prone to damage. When damage occurs, it is important that repairs are effected quickly, otherwise great expense may be incurred because a ship may be compelled to wait for loading whilst repairs are being made. Furthermore, in many ports and terminals it is a requirement that any such repairs must be carried out by an authorised mechanic when any such repair demands the use of tools or similar equipment.

Usually a lifting spreader is releasable coupled to a container by means of corner castings with oval apertures permanently fixed within the container top being coupled to rotatable twistlocks with oval locking heads mounted within the underside of a spreader. Twistlocks, in their open position, can be inserted into the said openings and after being rotated approximately 90 degrees to a locking position, secure the corner casting to the twistlock thereby coupling together the container and the spreader. Each twistlock is mounted in a bearing house or support plate and is rotated by an operating device, for example an hydraulic cylinder, which is releasably connected either directly or indirectly to the shaft of the twistlock.

The present invention discloses a construction which enables damaged twistlocks to be replaced without recourse to tools and without special knowledge or ability. This means that stevadores or crane operators can themselves effect repairs in a simple way and whereby the above-mentioned disadvantages can be avoided.

This invention discloses a manually easily mountable and demountable twistlock assembly, the shaft of said twistlock being provided with a groove around its circumference to accept a locking element such as a pair of semi-circular locking rings arranged to bear upon the twistlock bearing house thereby preventing axial displacement with lifting and whereby a casing, arranged to hold the locking rings in place in the twistlock groove, is prevented from axial displacement primarily by the bearing house and its associated elements during working rotation of 90 degrees and yet can be axially released for removal of the twistlock by its being turned past the extent of its normal working area, i.e. past either the twistlock locked or unlocked position.

The invention is below described with reference to the accompanying drawing, showing a selected example of a twistlock in a container spreader, where FIG. 1 shows a side view of the device, FIG. 2 shows a section of the device through the line II—II in FIG. 1, FIG. 3 shows a plan view of the device, FIG. 4 shows a section through an alternative arrangement of the device and FIG. 5 shows a section through line V—V in FIG. 4, FIGS. 6 and 7 in the same way as FIGS. 4 and 5 show yet a further alternative arrangement of the device.

In FIG. 1 the device in its entirety is marked with the FIG. 1. The twistlock is mounted in a hole through a corner of the spreader frame which is here shown in section and is marked 2. Within the hole, and firmly secured to the spreader is a bearing house 3, which rotatably supports a rotatable body 4, shown in more detail in FIG. 3, which is turnable by means of force applied to coupling 5.

The rotatable body 4, at its lower extremity and under the bearing house 3, has an oval shaped locking head 6, turnable through approximately 90 degrees by means of coupling 5. The locking head is shaped to coincide with the oval opening of a containers top corner casting so that the locking head in one position, the unlocked position, can be freely inserted into the opening and thereafter be rotated 90 degrees to a locked position wherewith the locking head 6 is secured with the container corner casting so that lifting is possible. The locking head 4 can be retained in either of two different positions.

The bearing house 3 shows a top part 7 and an under part 8, which by means of bolts 9 (FIG. 2) are mounted on opposing sides of the spreader beam plate 2. Protruding downwards from the under part 8, and on each side of the twistlock shaft, are guide shoulders 10 and 11, which are so formed to have the same plan shape as the locking head 6 and therefore can be guided into the opening in the container corner casting.

FIG. 2 shows are more detailed construction of the associated working parts of the bearing house 3 and the twistlock 4. In FIG. 2 is clearly shown the container corner casting 2 and how the bolts 9 bind together parts 7 and 8 which complete the bearing house for the throat 12 of a twistlock shaft 20. This figure also shows the locking head 6 as seen from the short side. The shaft 20 has in its upper part a collar 13 below the end part 14 of the shaft. Into the collar 13 are inserted two half-circle bearing rings 15 and 16 with such a diameter that they extend radially beyond the throat 12 of the shaft 20 and bear against a collar or against the over side of part 7. The bearing rings 15 and 16 are held in position in the groove 13 by a turning element 17, which is pushed over the shaft 20 end part 14. Between the end part 14 and the turning element 17 is a key 18 arranged for unturnable coupling of the turning element 17 to the end part 14. On the turning element is affixed an arm 19 which is activated through the coupling 5 to position the twistlock body 4 in either of the locked or unlocked positions, which as earlier stated are approximately 90 degrees displaced from each other. If desired, the key 18 can be retained in the end part 14 by means of a screw, as shown in FIG. 3.

To the turning element 17 is affixed a radially projecting cam 22 in a segment of not fully 90 degrees. Cam 22 engages with a slot 25 in a tube-shaped house 24 which is immovably affixed to the upper and lower parts 7 and 8. The tube-shaped house 24 contains an axially movable spring loaded catch 26 which in its upper parts supports a rectangular crosspiece 27 arranged to glide against the walls of a radial slot in upper part of the tube-shaped house. The catch 26 and the crosspiece 27 can glide axially in the house 28 so that crosspiece 27 in one position will axially coincide with the radial cam 22 whilst in another position will be pressed up so high that the cam can pass freely under the crosspiece 27. This arrangement is more clearly described with reference to FIG. 3.

FIG. 3 shows a corner casting of a container, which normally has such a corner casting in each of its four upper corners. FIG. 3 also shows the bearing house 3 and twistlock 4 together with some of the details of FIG. 1 and FIG. 2 earlier described.

In FIG. 3 is shown the arm 19 in angular position A, in which the twistlock is in the free position, in other words in that position in which the locking head 6 and shoulders 10 and 11 can be inserted freely into the oval opening in the containers upper corner casting. Coupling 5 can rotate the twistlock anti-clockwise from free position A to locked position B. In both positions A and B is the twistlock 4 blocked against rotation by catch 26. From FIG. 3 it is evident that catch 26 in the shown position prevents the entire twistlock 4 from being rotated anticlockwise because the cam 22 goes against the crosspiece 27 in the slot 25 as the catch 26 is in its lowest position so that the crosspiece 27 is in cam 22's path of movement. When the spreader is lowered and the twistlock assembly rests against the containers corner casting, the catch 26 is impressed and is in the same plane as the underside of the spreader 2.

When catch 26 is pushed upwards, the crosspiece 27 will be lifted above cam 22's path of movement and coupling 5 can therefore without hinder turn the whole twistlock 4 from position A to position B so that the locking head 6 adopts its working, lifting position. The shoulders 10 and 11 of the bearing house underpart 8 are made to be so long that when the spreader is resting upon the containers corner casting there will be a clearance between the top of the locking head 6 and the lifting contact area within the corner casting. This means that when the spreader is lifted so that the twistlocks make contact within the container corner casting, the catch 26 will move downwards so that the crosspiece 27 once again lies within the movement path of the cam 22 but in this case on the other side of the cam's extremity so that the twistlock is securely retained in angular position B for lifting.

As indicated above, there exists a list of regulations governing the security of lifting equipment for containers, and twistlocks shall have a wide margin of safety. In spite of its complicated function, the twistlock device according to the present invention is very simple to assemble and disassemble. To replace a twistlock shaft, which is that part most prone to damage or deformation so that the locking device does not function, is particularly easy.

The replacement of a twistlock is effected in the following way, in which the use of tools in any shape or form is not required. As described above, twistlock 20 is held in its axial position by means of the bearing rings 15 and 16 in the groove 13 being secured radially by turning element 17. The turning element 17 is held in its axial position through the combination of the radial cam 22 with the slot 25 in housing 24. From FIG. 3 it is obvious that cam 22 in its end position, which can be determined by the end positions of coupling 5, with its outer end in contact with slot 25 is prevented from moving upwards, whereby turning element 17 holds together parts 20, 15, 16, 22, 18 and 19 and holds them in place.

With disassembly, the operating rod of coupling 5 is manually removed from the arm 19 to which it is attached by ball-joint. The turning element 4 is thereby free to be rotated a further few degrees clockwise so that the cam's 22 outer corner is clear of the corner 29 of the tubeshaped housing 24. Thereafter can turning element 17 with arm 19, key 18, and screw 21 be lifted straight upwards and laid to one side. Both bearing rings 15 and 16 can then be removed radially outwards and finally twistlock 20 can be drawn free downwards and away from bearing house 3 and the spreader.

A new twistlock 20 can be assembled in the same easy way without tools by being pushed into bearing house 3 so far that bearing rings 15 and 16 can be replaced in groove 13. The turning element 17 is then pushed down over the end part 14 and the bearing rings 15 and 16 so that these will be locked into the groove 13. Finally the turning element 17 is rotated so that the ball-joint on arm 19 returns to that position where coupling 5 can be replaced whereby the whole assembly is once again ready for use through the cam 22 being turned so that it once again unites under the corner 29 in the tube-shaped house 24.

FIG. 4 shows the upper section of an alternative arrangement in section and the same markings are used as in the earlier figures. This figure discloses an alternative arrangement which prevents turning element 17 within the working area A–B from gliding axially upwards so that the bearing rings 15 and 16 can come out of position. In the arrangement according to FIG. 4, the key 18 is fastened to the turning element 17 with a screw 21. When the arm 19 is rotated from A to B, the key 18 is also turned from A to B, as in FIG. 3. When the turning element 17 is axially moved, the key 18 glides in a slot 23 in the end part 14. Concentric with the end part 14 is a stud 30 with the same diameter as the end part 14 and with a length which permits turning element 17 to glide upwards until its underside rises above the upper edge of bearing rings 15 and 16. The stud 30 is affixed to a bearing plate 31 which is indirectly united with the bearing house's upper part 7. Stud 30 has a keyway 32 which has such dimensions that the key 18 can be pushed into the keyway when the end part 14 is at such an angle that slot 23 and keyway 32 are opposite each other.

In the right half of FIG. 4 is shown how the turning element 17 is pushed upwards away from its bearing rings 15, 16 axial securing position the key 18 being entered into keyway 32. The left half of the figure shows that position where the turning element 17 has reached its end position against bearing plate 31. In this position the bearing rings 15, 16 are no longer secured radially, but can be drawn out from groove 13 as is shown for bearing ring 16 in the diagram. When both bearing rings 15, 16 have been withdrawn, twistlock 20 can be removed downwards and demounted from the assembly. Re-assembly with a new twistlock is effected in the reverse order and bearing rings 15, 16 are secured by turning element 17 being pushed downwards after the twistlock has been positioned so that slot 23 is opposite keyway 32. The turning element's locking collar 34 then lies outside and around bearing rings 15, 16 thereby preventing these from moving radially outwards.

FIG. 5 shows a section through line V—V in FIG. 4. This diagram shows that stud 30 has two keyways 32 and 33 for acceptance of key 18. In this diagram are also shown the end positions A and B for the key 18's rotation within the working area A–B. As can be seen, keyways 32 and 33 lie outside this working area. If turning element 17 is rotated so that key 18 lies in the middle of keyway 33 then turning element 17 can be lifted in the same way as described above. Keyway 33 can be placed in such a position where it would be easiest to manually effect demounting of bearing rings 15 and 16. To ensure that turning element 17 shall remain in its axially lower locking position, keyways 32 and 33 shall not lie within the working area A–B otherwise the key may unwillingly glide up into the groove and the bearing rings 15 and 16 come loose. Keyways 32 and 33 can otherwise be placed in any desired position outside this working area.

FIGS. 6 and 7 show yet another possible example of the invention, where for the same parts the same indication figures have been used. Bearing rings 35 and 36 extend further in a direction in which holes 37, 38 are arranged to unite with studs 39, 40 within a turning element 41 united with an arm 19. Studs 39, 40 prevent bearing rings 35, 36 from gliding out from groove 13. The turning element has a central rectangular recess which unites with the rectangular part 46 of the throat part 12 in order to rotate the locking part 6.

The turning element rotates between positions A and B, see FIG. 7. Above the turning element's flange 47 and united with upper part 7 are two tongues 44, 45. The flange shows two recesses 42, 43 which normally move between the tongues 44, 45. If the operating part is removed from the arm 19, the turning element 41 rotates so that recesses 42, 43 coincide with tongues 44, 45 and can be lifted axially upwards. Studs 39, 40 are pulled out from the holes 37, 38, and the bearing rings 35, 36 and twistlock 20 can be dismantled and reassembled as described previously.

The described constructions and diagrams are examples given only to explain the purpose and background of the invention, and one skilled in the art could achieve many other constructions which would fall within the bounds of the following patent claims.

I claim:

1. A locking device assembly or twistlock assembly for mounting into a lifting beam or spreader, for releasable coupling to an object to be lifted, such as a container, having at its top side corner castings incorporating oval openings, the spreader (2) having rotatable twistlocks (20) with oval locking heads (6) which in their open position (A) in a way known per se can be inserted into said openings and after being rotated approximately 90 degrees to a locking position (B) secure the corner castings to the twistlock heads (6) thereby coupling together the container and the spreader, each twistlock (20) being mounted in a bearing house and rotated by an operating device (5), e.g. a hydraulic cylinder, and being releasably connected to a coupling means, such as a turning element (17, 41), surrounding the opposite end part (14) of the locking head of the twistlock (20) and demountably but unturnably affixed to the twistlock (20), e.g. by a key (18), characterized in each twistlock (20) below the end part (14) opposite the head having an annular groove (13) for insertion of radially removable bearing elements (15, 16), e.g. a split bearing ring, forming a stop to the bearing plate (3) of the twistlock, for fixation of the shaft (20) to axial displacement at lifting whereat the turning sleeve element (17, 41) is arranged to keep the bearing rings (15, 16) in their position in the groove (13) of the twistlock and that the turning sleeve element (17, 41) is also arranged to be fixed to axial displacement by interacting means (22–25; 17, 30, 31; 41–44, 45) acting between the turning sleeve element (17, 41) and its fixed surrounding parts, in the first place said bearing plate (3), in such a way that the sleeve element is fixed axially at rotation within the working area (A–B), i.e. from the open position (A) of the twistlock to its locking position (B) and vice versa, but is released axially for freeing and removing the bearing rings (15, 16) at rotation outside the working area, thus passing said positions (A, B).

2. Locking device according to claim 1, characterized in that the turning sleeve (17) has an annular, axially downward extending portion (34) arranged to surround the outer pherifery surface (FIGS. 2, 4) of the bearing rings (15, 16).

3. Locking device according to claim 2, characterized in that the turning sleeve (17) for fixation to axial displacement has a radially protruding, flange (22) in the form of a sector arranged for coaction with a fixed stop (24) including a groove (25) for slidably accommodation of the flange (22).

4. Locking device according to claim 2, characterized in that the turning sleeve (17) is fixed to a key (18) slidably accommodated in a keyway (23) at the end part (14) of the twistlock (20) and is axially locked by a pin (30), being concentric with the end part (14) of the twistlock and having a radial extension such that it prevents the key (18) to being displaced in the keyway (23) of the twistlock and part (14) within the working area (A–B) but may be displaced axially when the pin (14) is turned such that the key (18) has been displaced outside the working area (A–B) to a keyway (32) of the pin (30).

5. Locking device according to claim 1, characterized in that the turning sleeve (41) is arranged axially above the bearing rings (35,36) and have axially depending pins (39, 40) arranged to keep the bearing rings in place by coaction with holes (37, 38) in the bearing rings (35, 36).

6. Locking device according to claim 1, characterized in that the turning sleeve (47) is formed with a radially extending, annular flange (41) fixing the turning sleeve to axial displacement by coaction with a stop (44, 45) arranged axially above the flange (41).

7. Locking device according to claim 6, characterized in that the flange (41) at turning of the twistlock (20) outside the working area (A–B) has recesses (42, 43) for the stops (44, 45) the recesses making an axial displacement of the turning sleeve (47) possible for freeing the bearing rings (35, 36).

8. Locking device according to claim 1, characterized in that the twistlock (20) is turned by the operating device (5) by means (19, 17, 18, 23; 19, 47) axially displaceable but unturnable arranged at the end part (14; 46) of the twistlock (20).

* * * * *